US010537184B2

(12) United States Patent
Kramer et al.

(10) Patent No.: US 10,537,184 B2
(45) Date of Patent: Jan. 21, 2020

(54) SPLIT ADJUSTABLE MATTRESS FOUNDATION FOR MULTIPLE USERS

(71) Applicant: Dreamwell, Ltd., Atlanta, GA (US)

(72) Inventors: Kenneth L. Kramer, Greensburg, IN (US); Jeffrey M. Woodall, Greenfield, IN (US); Francis Jan, Atlanta, GA (US)

(73) Assignee: DREAMWELL, LTD., Atlanta, GA (US)

( * ) Notice: Subject to any disclaimer, the term of this patent is extended or adjusted under 35 U.S.C. 154(b) by 266 days.

(21) Appl. No.: 15/805,553

(22) Filed: Nov. 7, 2017

(65) Prior Publication Data

US 2019/0133331 A1 May 9, 2019

(51) Int. Cl.

| | |
|---|---|
| ***A47C 20/10*** | (2006.01) |
| ***A47C 20/04*** | (2006.01) |
| ***A47C 20/08*** | (2006.01) |
| ***A47C 19/02*** | (2006.01) |

(52) U.S. Cl.

CPC ..... *A47C 19/028* (2013.01); *A47C 19/021* (2013.01); *A47C 19/025* (2013.01); *A47C 20/041* (2013.01); *A47C 20/08* (2013.01); *A47C 20/10* (2013.01)

(58) Field of Classification Search

None

See application file for complete search history.

(56) References Cited

U.S. PATENT DOCUMENTS 3,362,673 A * 1/1968 Patch ..... B01D 61/30 248/397
4,228,664 A * 10/1980 McCoy ..... F16D 1/08 464/73
4,893,365 A 1/1990 Justice
(Continued)

FOREIGN PATENT DOCUMENTS

WO 2017044116 A1 3/2017

OTHER PUBLICATIONS

Search Report for International Application No. PCT/US2018/051059 dated Nov. 30, 2018 (5 pages).
(Continued)

*Primary Examiner* — Robert T Clarke, Jr.
*Assistant Examiner* — Adam C Ortiz
(74) *Attorney, Agent, or Firm* — Cantor Colburn LLP

(57) ABSTRACT

Adjustable mattress assemblies and processes including an adjustable mattress foundation dimensioned to support a mattress configured to accommodate two supine users during use thereof includes a foundation frame including a first sub-foundation configured with at least one motorized actuator to effect inclination or declination of the mattress support surface and an abutting second sub-foundation free of a motorized actuator. The second foundation is mechanically coupled to the first foundation such that articulation of the first sub-foundation results in a similar articulation in the second foundation. The first and second foundations have similar length, height and width dimensions, which collectively approximates the size of the oversized mattress configured to accommodate two supine users, e.g., king size, queen size, California king size, or the like.

7 Claims, 11 Drawing Sheets

(56) References Cited

U.S. PATENT DOCUMENTS

| | | | | |
|---|---|---|---|---|
| 6,163,904 | A * | 12/2000 | Royston | A47C 20/041 5/600 |
| 7,000,269 | B2 | 2/2006 | Borda | |
| 2009/0077747 | A1 | 3/2009 | Kim | |
| 2014/0075674 | A1* | 3/2014 | Chun | A61G 7/018 5/618 |
| 2017/0325592 | A1* | 11/2017 | Suh | A47C 20/041 |

OTHER PUBLICATIONS

Written Opinion for International Application No. PCT/US2018/051059 dated Nov. 30, 2018 (7 pages).

* cited by examiner

SPLIT ADJUSTABLE MATTRESS FOUNDATION FOR MULTIPLE USERS

BACKGROUND

The present disclosure generally relates to mattress assemblies, and more particularly, to mattress assemblies including a split adjustable mattress foundation for multiple users.

Adjustable mattress assemblies, also commonly referred to as articulating beds are commonly used in the healthcare field and in residential applications. A typical adjustable mattress assembly includes foundation for supporting a mattress. The foundation includes a base and an adjustable mattress frame or support, which is divided into a head and back section, an intermediate seat section, and a leg and foot section. The mattress frame sections are pivotally interconnected within the base and have a continuous range of adjustment. The sections are moveable from a flat, user resting position to a seated position with the legs bent or the legs straight and/or the patient's back angled upwardly with respect to the seat section. The various sections are pivoted by motor drives, hand operated cranks or through the user's weight.

Adjustable mattress assemblies configured to accommodate two sleeping individuals such as queen sized and king sized mattress assemblies are heavy and difficult to maneuver during installation and assembly. These types of adjustable mattress assemblies are typically formed utilizing two identical twin XL adjustable foundations that about one another, which is costly due to the duplication of components such as linear actuators, electronic controls, and the like.

BRIEF SUMMARY

Disclosed herein is an adjustable mattress assembly dimensioned to support a mattress configured to accommodate two supine users and process of operation. In one or more embodiments, the adjustable mattress assembly dimensioned to support a mattress configured to accommodate two supine users includes a foundation frame comprising a first sub-foundation and a second sub-foundation, wherein the first sub-foundation abuts and has similar dimensions as the second sub-foundation, wherein the first and second sub-foundations comprise side frame members and transverse frame members attached at respective ends of the side frame members to define a generally rectangular shape, and at least one cross rail extending between the side frame members, wherein each of the first and second sub-foundations includes a mattress support surface collectively configured to support a mattress dimensioned to accommodate the two supine users, the mattress support surface including a head and back section hingedly connected to an intermediate seat section at one end and a leg and foot section hingedly connected to the intermediate seat section at another end, wherein the intermediate seat section includes a first portion and a second portion, wherein the first portion is hingedly connected to the head and back section and the second portion is hingedly connected to the leg and foot section; a linkage assembly in each of the first and second sub-foundations, wherein the linkage assembly comprises a linkage support frame configured to be seated on the respective sub-foundation frame, first and second spaced apart torsional members coupled to the linkage support frame underlying each end of the intermediate seat section, a cross bar coupled to the linkage support frame and underlying a selected one of the first and second torsional members, and link arms having an end pivotally connected to crank arms coupled to the first and/or second torsional members; first and second shafts mechanically coupling the first and second torsional members in the first sub-foundation to the first and second torsional members in the second sub-foundation; and one or more motorized actuators in the first sub-foundation having one end coupled to the cross rail and another end coupled to one of the crank arms effective to selectively rotate the first and/or second torsional members in the first sub-foundation to effect inclination or declination of the head and back section and/or the leg and foot section, wherein rotation of the first and/or second torsional members in the first sub-foundation rotates the first and/or second torsional members in the second sub-foundation via rotation of the first and/or second shafts.

A process for operating an adjustable mattress assembly dimensioned to support a mattress configured to accommodate two supine users includes providing a foundation frame comprising a first sub-foundation and a second sub-foundation, wherein the first sub-foundation abuts and has similar dimensions as the second sub-foundation, wherein each of the first and second sub-foundations includes a mattress support surface collectively configured to support the mattress dimensioned to accommodate the two supine users, the mattress support surface including a head and back section hingedly connected to an intermediate seat section at one end and a leg and foot section hingedly connected to the intermediate seat section at another end, wherein the intermediate seat section includes a first portion and a second portion, wherein the first portion is hingedly connected to the head and back section and the second portion is hingedly connected to the leg and foot section; and actuating one or more motorized actuators in the first sub-foundation to effectively rotate one or more torsional members therein to effect inclination or declination of the head and back section and/or the leg and foot section via a linkage assembly, wherein rotating the one or more torsional members in the first sub-foundation rotates one or more torsional members in the second sub-foundation to effect the same inclination or declination of the head and back section and/or the leg and foot section, wherein the second sub-foundation is free of motorized actuators.

In one or more embodiments, the process for forming an adjustable foundation dimensioned to support a mattress configured to accommodate two supine users includes laterally connecting a first sub-foundation abutting a second foundation to define the adjustable foundation, wherein each of the first and second sub-foundations includes a mattress support surface collectively configured to support the mattress dimensioned to accommodate the two supine users, the mattress support surface including a head and back section hingedly connected to an intermediate seat section at one end and a leg and foot section hingedly connected to the intermediate seat section at another end, wherein the intermediate seat section includes a first portion and a second portion, wherein the first portion is hingedly connected to the head and back section and the second portion is hingedly connected to the leg and foot section, wherein the first sub-foundation comprises a linkage assembly including one or more torsional members each coupled to one or more motorized actuators to effect inclination or declination of the head and back section and/or the leg and foot section, and wherein the second sub-foundation is free of a motorized actuator and comprises linkage assembly including one or more torsional members; and mechanically connecting a shaft to the torsional members in the first sub-foundation to the torsional members in the second sub-foundation such that the motorized actuator in the first sub-foundation effects inclination or declination of the head and back section and/or the leg and foot section in the second sub-foundation.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

The present disclosure is generally directed to adjustable mattress assemblies including an adjustable mattress foundation dimensioned to support a mattress configured to accommodate two supine users during use thereof and processes of operation. As will, be described in greater detail wherein, the adjustable mattress foundation includes a first sub-foundation configured with at least one linear actuator and electronic controls to effect articulation and a second foundation free of a linear actuator and electronic controls. The second foundation is mechanically coupled to the first foundation such that articulation of the first foundation results in a similar articulation in the second foundation. The first and second foundations have similar length, height and width dimensions, which collectively approximates the size of the oversized mattress configured to accommodate two supine users, e.g., king size, queen size, California king size, or the like. As such, the adjustable mattress foundation of the present invention does not have duplication of components and electronic controls as noted in the prior art and is much more maneuverable due to its lighter weight and the use of two smaller foundation frames that define the adjustable mattress foundation.

Figure 1:
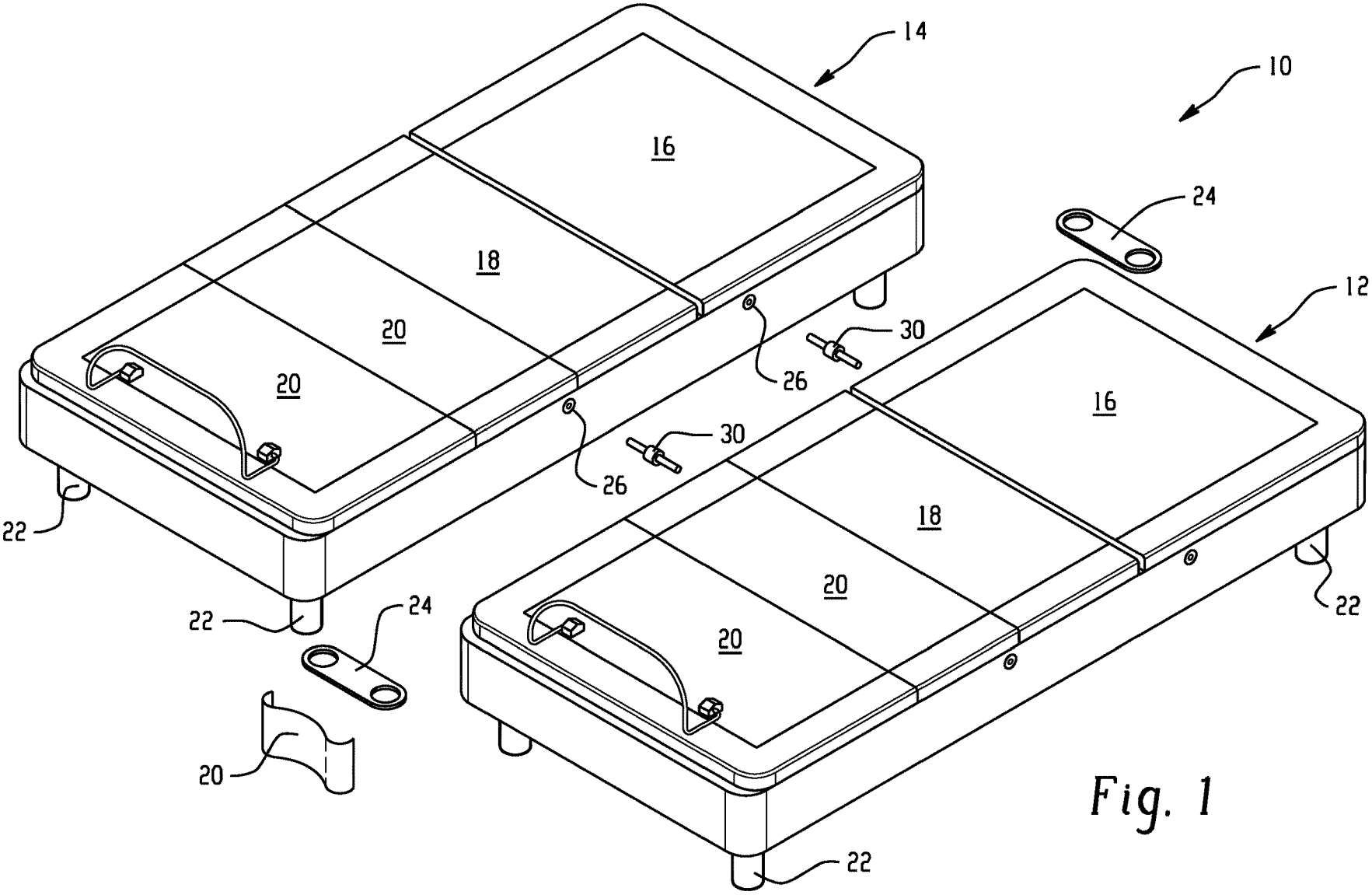
FIG. 1 ("FIG.") is a perspective view of an adjustable foundation including two spaced apart sub-foundations in accordance with the present disclosure.

Referring now to FIG. 1, there is depicted a perspective view showing an adjustable mattress foundation assembly 10 in accordance with the present disclosure. The adjustable mattress foundation assembly 10 is generally defined by two sub-foundations 12 and 14, which are shown as spaced apart from one another. The exterior surfaces and dimensions of each sub-foundation 12, 14, are substantially identical to one another. Each sub-foundation 12 and 14 includes a head and back section 16, an intermediate seat section 18, and a leg and foot section 20. The leg and foot section 20 is composed of two planar sections hingedly connected to one another. As will be discussed in greater detail herein, sub-foundation 12 includes a linear actuator to effect articulation of the different planar sections defining the support surface in both sub-foundations 12, 14 of the adjustable mattress foundation assembly 10. The adjustable mattress foundation 10 is movable between a fully horizontal position and a fully inclined, wherein the head and section and the leg and foot section are shown be elevated relative to the intermediate seat section. An operator or user may sleep with the adjustable bed 10 generally in its fully horizontal position, in the fully inclined position, or in any position therebetween.

The sub-foundations 12, 14 can be supported by legs 22 at each corner of the respective foundation, which can be adjustable as may be desired in some applications. When assembled, the sub-foundations 12, 14, are placed in an abutting relationship and can include leg retainers 24 (i.e., leg connector) to prevent separation of the adjustable mattress foundation assembly during use by mechanically locking sub-foundation 12 to sub-foundation 14 by securing the interior legs of each sub-foundation to one another as shown. In an exemplary embodiment, the leg retainers 18 generally including a planar strip of rigid material such as a metal or plastic having a width greater than a diameter of the legs. The planar strip has a defined length and includes openings at each end such that when the interior legs are retained by the leg retainer, the sub-foundations 12, 14 abut one another. The openings have a complementary shape to the cross sectional shape of a respective leg 16 and are configured to receive the respective legs and maintain the abutting relationship of sub-foundation 12 to sub-foundation 14. A decorative leg cover 20 can be provided on the legs as secured if desired.

In one or more embodiments, the adjustable mattress foundation can be free of legs elevating the first and second sub-foundations. In these embodiments, a fastener, e.g., shear pins, can be used to fasten abutting sidewalls of the first and second sub-foundation so as to prevent lateral movement during use thereof.

Figure 2:
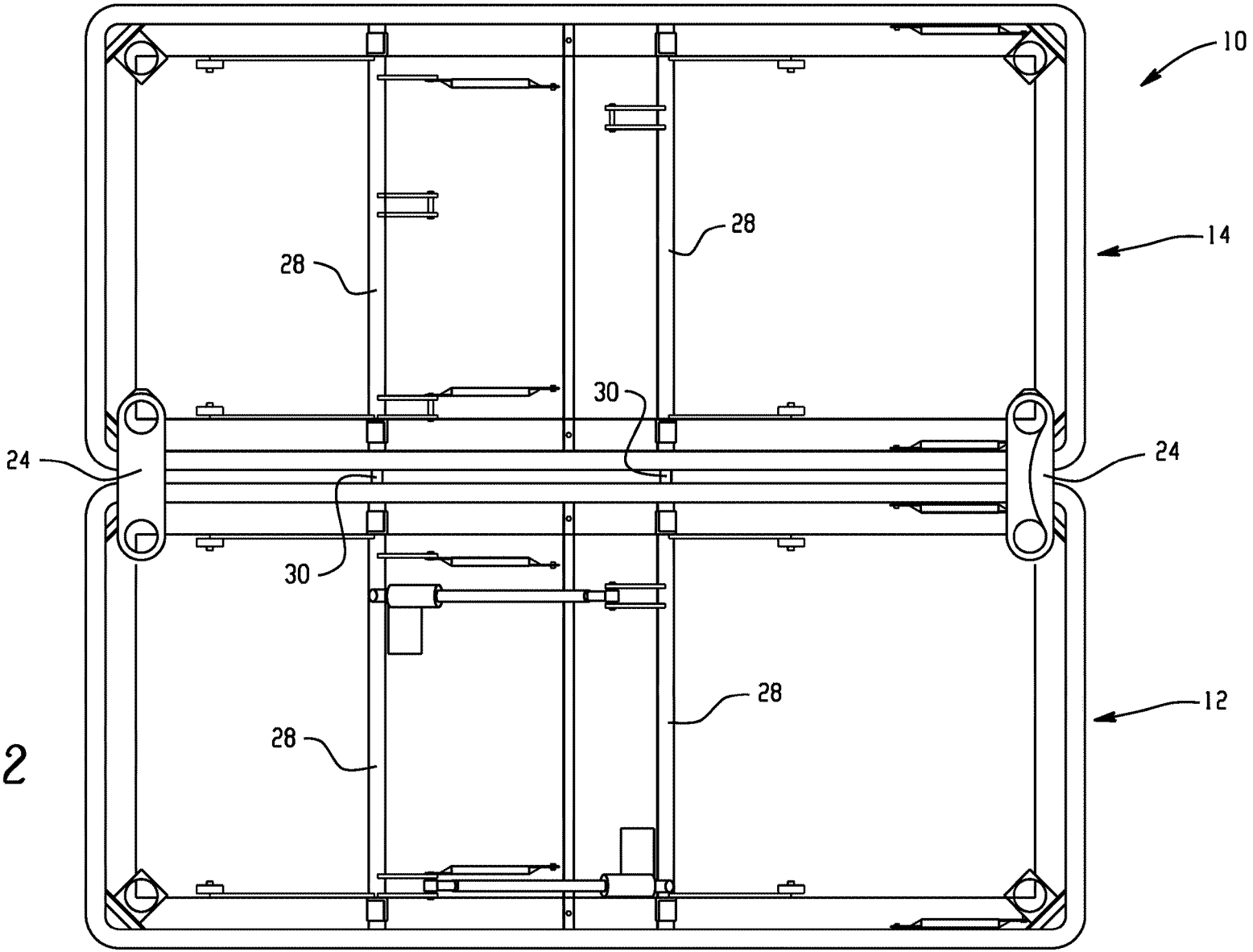
FIG. 2 is a bottom view illustrating the bottom of the adjustable foundation including two abutting sub-foundations in accordance with the present disclosure.

Each interior facing side of sub-foundation 12 and sub-foundation 14 include openings 26 to accommodate connection of the torsional shafts 28 (see FIG. 2) in each sub-foundation 12, 14 via a shaft 30 coupled to respective ends of the torsional shafts extending therebetween. Rotation of the torsional shaft in sub-foundation 12 via an actuator will cause rotation of the torsional shaft in the sub-foundation 14 via the shaft 30 coupling the respective torsional shafts. By way of example, shaft 30 can be a hexagonal shaft, wherein each end of the torsional shaft can include a hexagonal shaped opening to receive the respective ends of the hexagonal shaft, thereby providing the coupling between torsional shafts in each sub-foundation.

Figure 3:
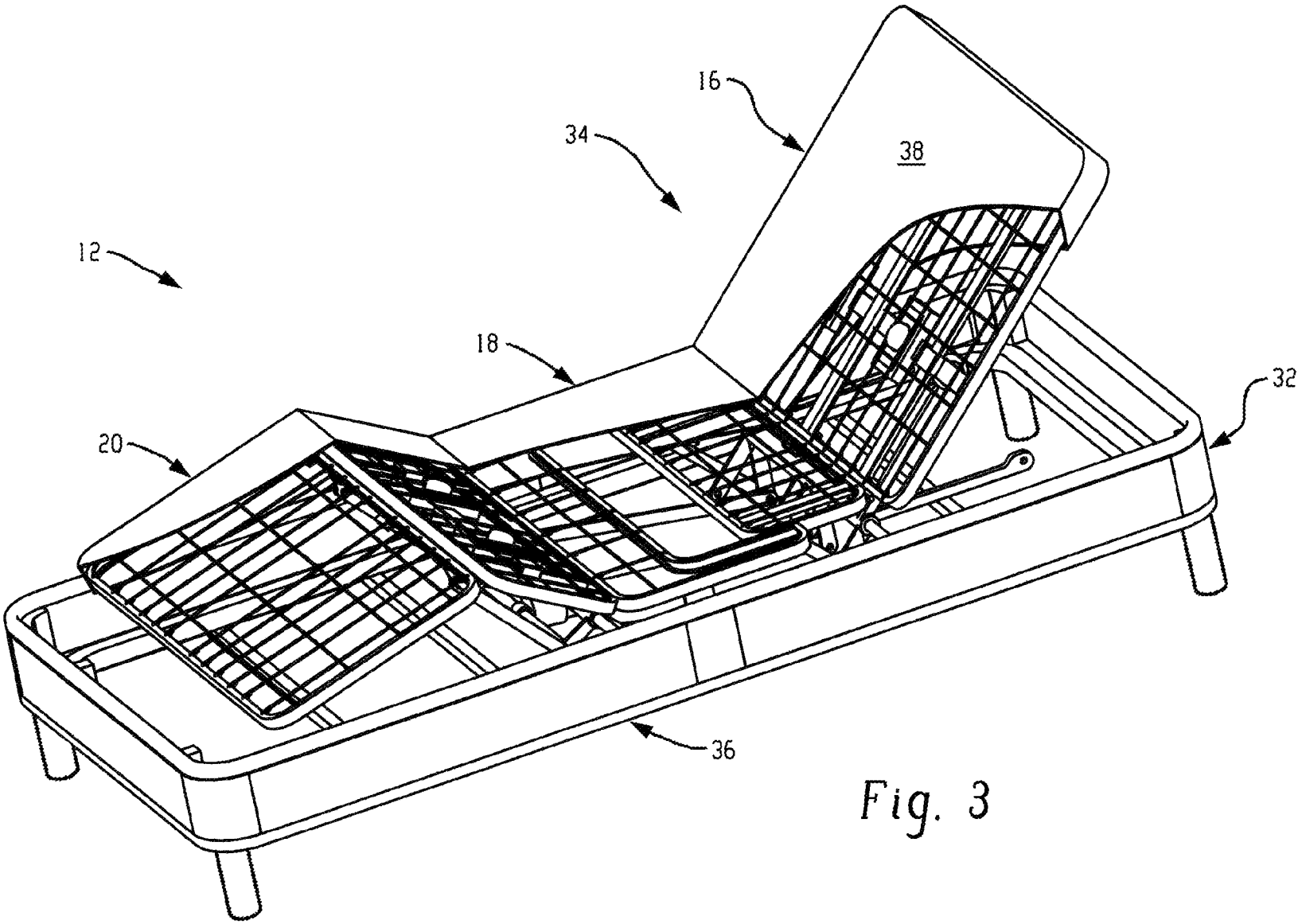
FIG. 3 is a perspective view of a sub-foundation in accordance with the present disclosure.
Figure 4:
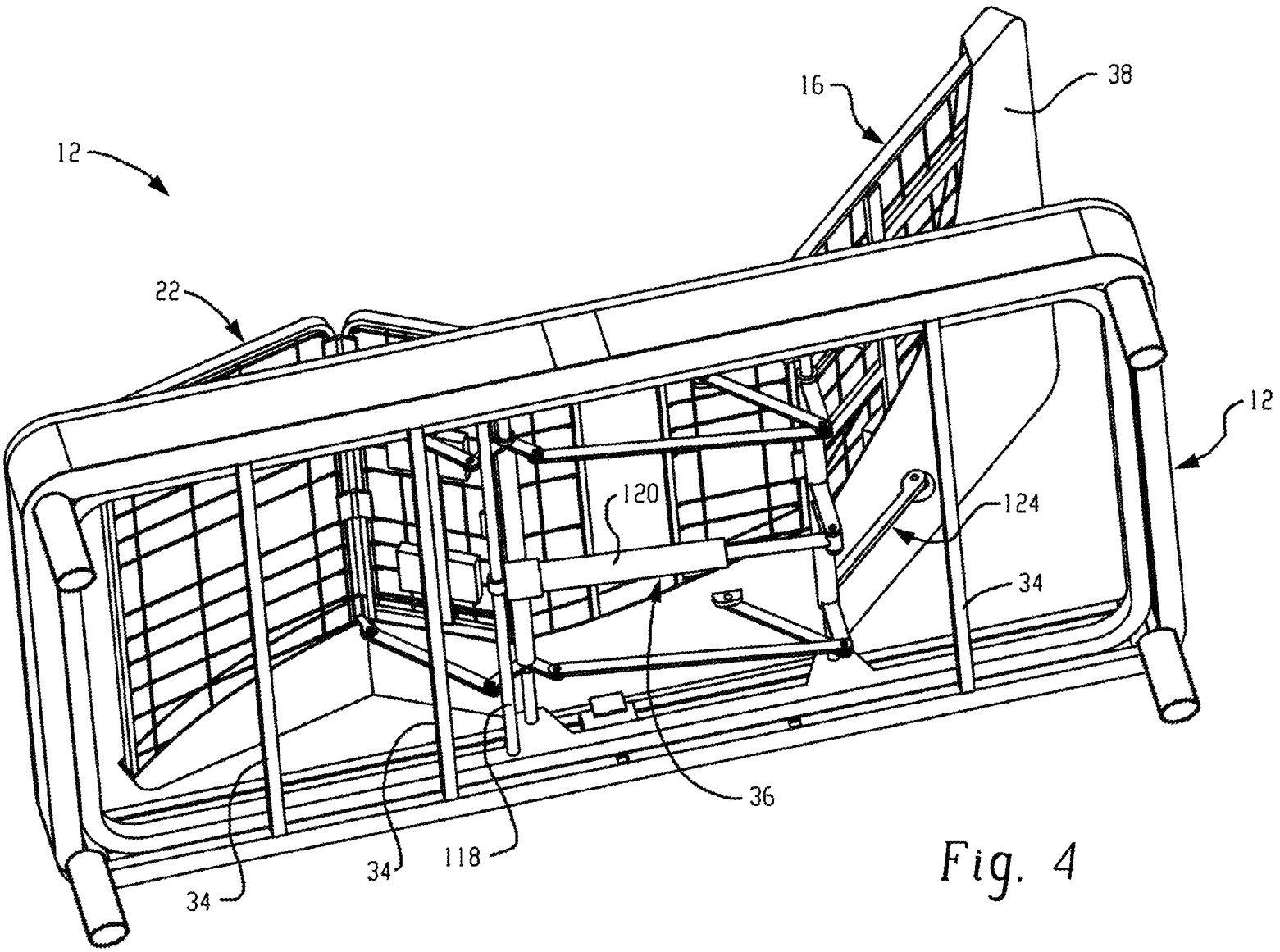
FIG. 4 is a bottom perspective view of the sub-foundation of FIG. 3 frame in accordance with the present disclosure.

Referring now to FIGS. 3-4, sub-foundation 12 includes a generally rectangular foundation frame 32, a mattress support surface 34, and a linkage assembly 36 (shown more clearly in FIG. 4). It should be noted that sub-foundation 14 is substantially the same as sub-foundation 12 with the exception that sub-foundation 12 includes a motorized actuator, e.g., a motorized linear actuator, to effect rotation of the torsional shafts 28 therein whereas sub-foundation 14 does not, which will effect rotation of the torsional shafts 28 in sub-foundation 14 via hexagonal shaft 30. In one or more embodiments, the motorized actuator is proximate to an abutting sidewall of the first sub-foundation so as to minimize torsional rigidity during operation thereof.

The linkage assembly 36 is operable to articulate the various sections of the mattress support surface 34, which can include the head and back section 16, the intermediate seat section 18, and the leg and foot section 20. A covering 38 is disposed about the various sections 16, 18 and 20, wherein a partial cutaway view is provided in the Figures. The covering 38 may be padded and may include a rigid substrate such as wood or plastic. In one or more embodiments, the intermediate seat section 18 can be formed of two pieces configured to increase in length upon articulation of the head and back section 16 and/or the leg and foot section 20 from a flat position or an increase in inclination. Likewise, the intermediate seat section 18 is configured to decrease in length upon articulation of the head and back section 16 and/or the leg and foot section 20 from an inclined position to a flat position or a decrease in length upon declination of any section. By doing so, a supine user does not have to shift his position on the mattress in order to accommodate the inclination or declination. Additionally, a mattress disposed thereon has been found to better contour to the shape provided by the different sections during articulation, which also helps minimize pinch points.

Figure 5:
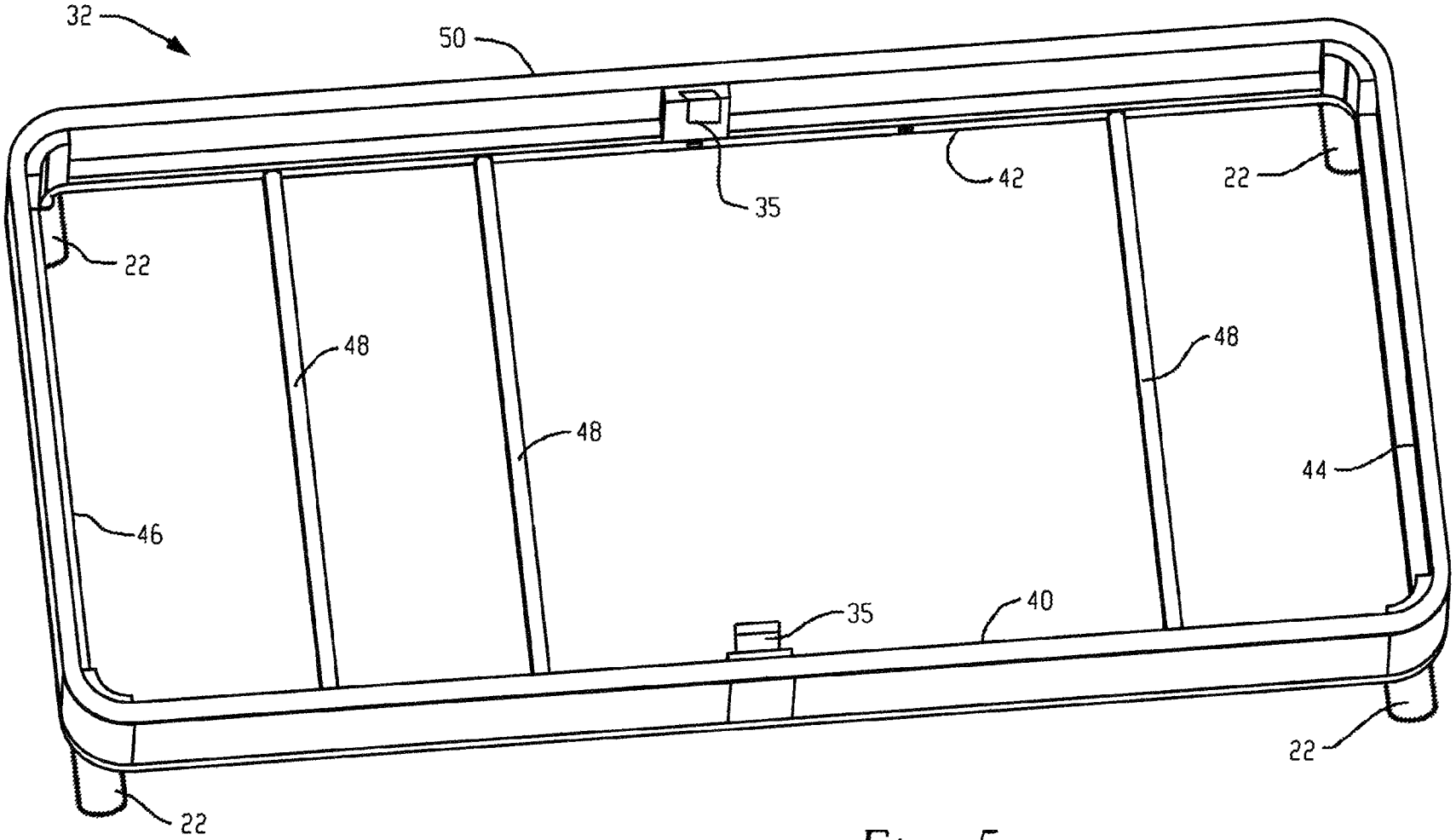
FIG. 5 is a perspective view of the sub-foundation frame in accordance with the present disclosure.

As shown more clearly in FIG. 5, the generally rectangular foundation frame 32 generally includes side frame members 40, 42, transverse frame members 44, 56 attached to respective ends of the side frame members to define the generally rectangular shape to the foundation frame 32, and support legs 22 at corners of the foundation frame 32 for elevating the foundation frame relative to ground. The support legs 22 may be secured to the frame members. The foundation frame 32 further includes one or more cross rails 48 extending from one side rail 40 to the other side rail 42. A frame casing 50 is disposed about a perimeter of the foundation frame 32 and has a width sufficient to shield the linkage assembly 36 from view when the various sections 16, 18, and 20 of the mattress support surface 34 are in a flat horizontal position. The frame casing 50 as shown extends upward from the foundation frame, i.e., the frame casing 50 is attached at about a lower surface thereof to the foundation frame 32. The cross rails 48 are spaced about and are configured to provide additional support to the mattress support surface 34 as well as provide an opening sufficient to accommodate the linkage assembly 36, which primarily underlies the intermediate or seat portion 18. As shown, two cross rails 48 are spaced apart from one another and generally positioned to support the leg and foot section 20, and one cross rail is generally positioned to support the head and back section 16. However, it should be apparent that more or less cross rails could be utilized.

Figure 6:
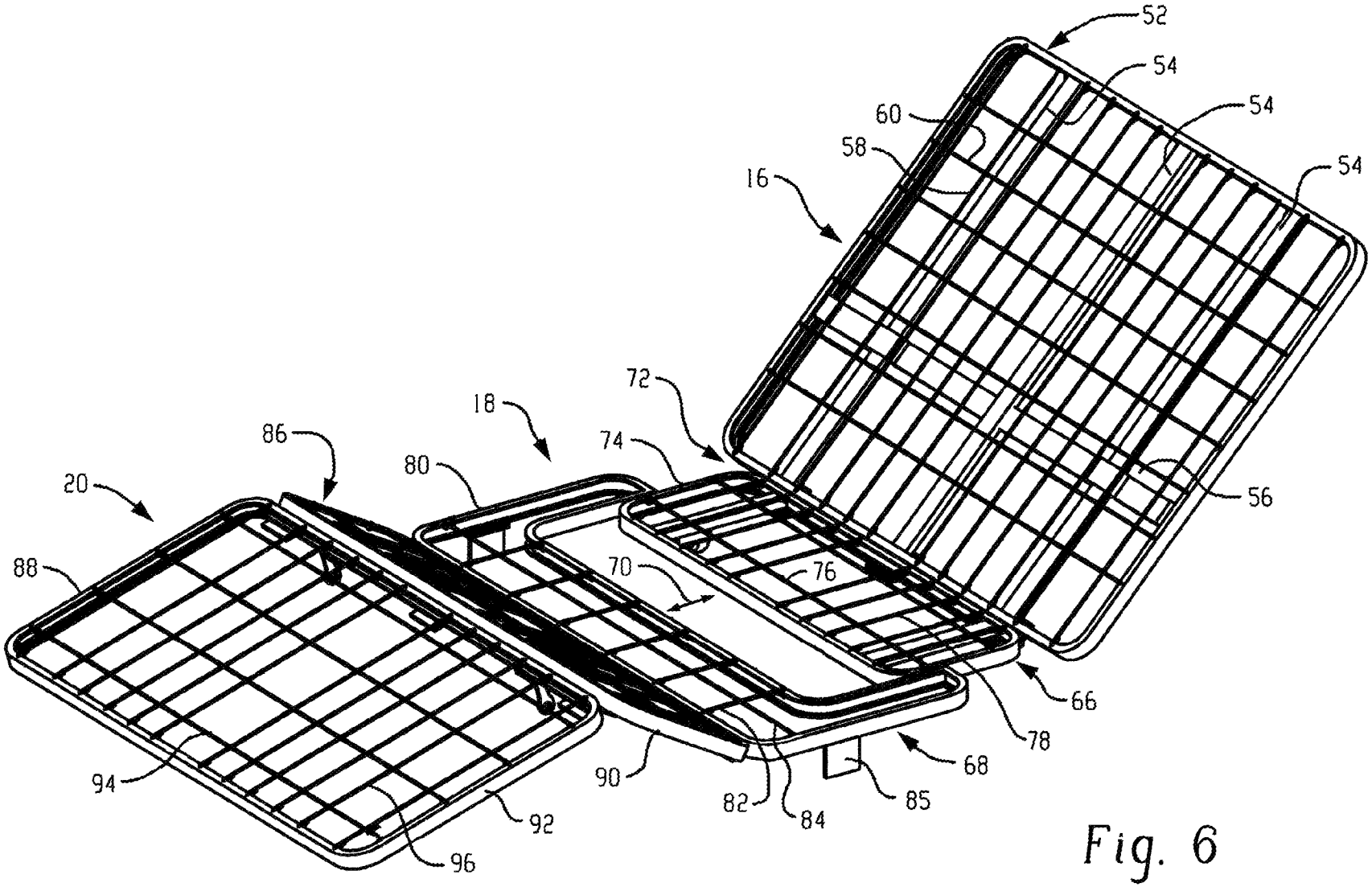
FIG. 6 is a perspective view of the mattress support surface of the sub-foundation frame in accordance with the present disclosure.

As shown more clearly in FIG. 6, the illustrated head and back section 16 includes a rigid frame 52 including three longitudinal cross members 54 extending from one side of the frame to an opposing side and a transverse cross bar 56. At least two of the longitudinal cross members 54 are equally spaced from a midline of the rigid frame and positioned to be in general alignment with a roller arm of the linkage assembly 26. As will be discussed in greater detail below, the roller arm engages the longitudinal cross member 54 of the head and back section 16 during operation thereof. The third longitudinal cross member 54 may be at a midline of the rigid frame 52, which provides additional support to the frame. Transverse cross bar 56 is disposed at a lower portion of the rigid frame. The rigid frame 52 has a width dimension about equal to a width of a mattress to be used with the adjustable foundation. The length of the rigid frame 52 is generally dimensioned to at least accommodate the length of a typical user's head and back section. A plurality of transverse and longitudinal wires 58, 60, respectively, may be coupled to a top surface of the rigid frame 52 so as to provide additional support to the mattress when in use.

In one or more embodiments, the intermediate seat section 18 can include a first portion 66 and a second portion 68, wherein the first and second portions collectively define the seat section 18 and function to increase a length of the intermediate seat section 18 when the adjustable mattress foundation 10 is raised from a flat position to an inclined position. In a similar manner, the first and second portions 66, 68, respectively, function to shorten a length of the intermediate or seat section 20 when the adjustable mattress foundation 10 is declined, e.g., from an inclined position to a flat position. The increase or decrease in length is represented by arrow 70. The first portion 66 includes a rigid frame 74 hingedly connected at one end to the head and back section rigid frame 52 such that the head and back section 16 pivots at pivot point 72 when inclined or declined. The other frame end is a free end and is close to or abuts the second portion 68 when the adjustable mattress foundation 10 is in a flat position. The rigid frame 74 may further include a plurality of transverse and longitudinal wires 76, 78, respectively, coupled to a top surface thereof. Advantageously, the motion and extension of the first portion 66 of the intermediate seat section 18 causes the head and back section 16 to slide towards the wall, which helps to counteract the amount of distance that the mattress is traveling away from the headboard in order for the occupant to maintain proximity to the night stand. The motion and extension of the first portion 66 eliminates the need for an additional retracting frame.

The second portion 68 includes u-shaped rigid frame 80 and is hingedly connected to the leg and foot section 20 at one end. The other end includes an opening defined by the u-shaped rigid frame. During operation, the first portion 66 is dimensioned to laterally move within the u-shaped opening provided in the second portion 68, wherein the second portion 68 is stationary. The rigid frame 80 may further include a plurality of transverse and longitudinal wires 82, 84, respectively, coupled to a top surface thereof. Coupled thereto are support members 85, which are configured to seat upon the side members 40, 42 of the foundation frame 32 when assembled so as to provide additional support. For example, foundation frame can include a bracket 35 (see FIG. 5) configured to lockingly receive the support members 85.

The leg and foot section 20 includes first and second portions 86, 88 hingedly connected to one another, wherein first portion 86 is also hingedly connected to the intermediate seat section 20 as described above. Similar to the sections 16, 18 above, the first and second portions 86, 88 of the leg and foot section 20 include rigid frames 90, 92, respectively, and a plurality of transverse and longitudinal wires 94, 96, respectively, coupled to a top surface thereof.

Figure 7:
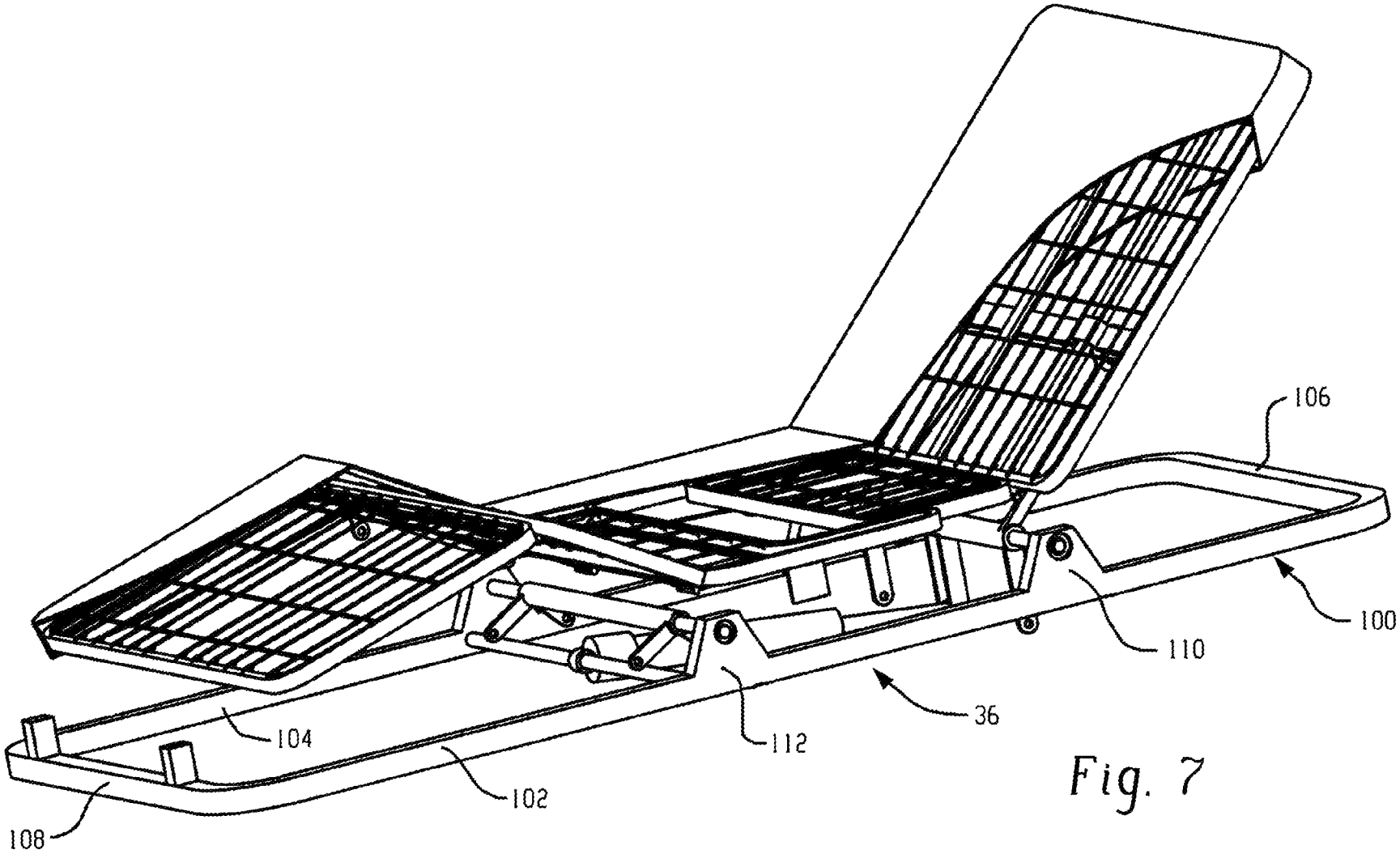
FIG. 7 is a perspective view illustrating the mattress support surface and the linkage assembly frame in accordance with the present disclosure.
Figure 8:
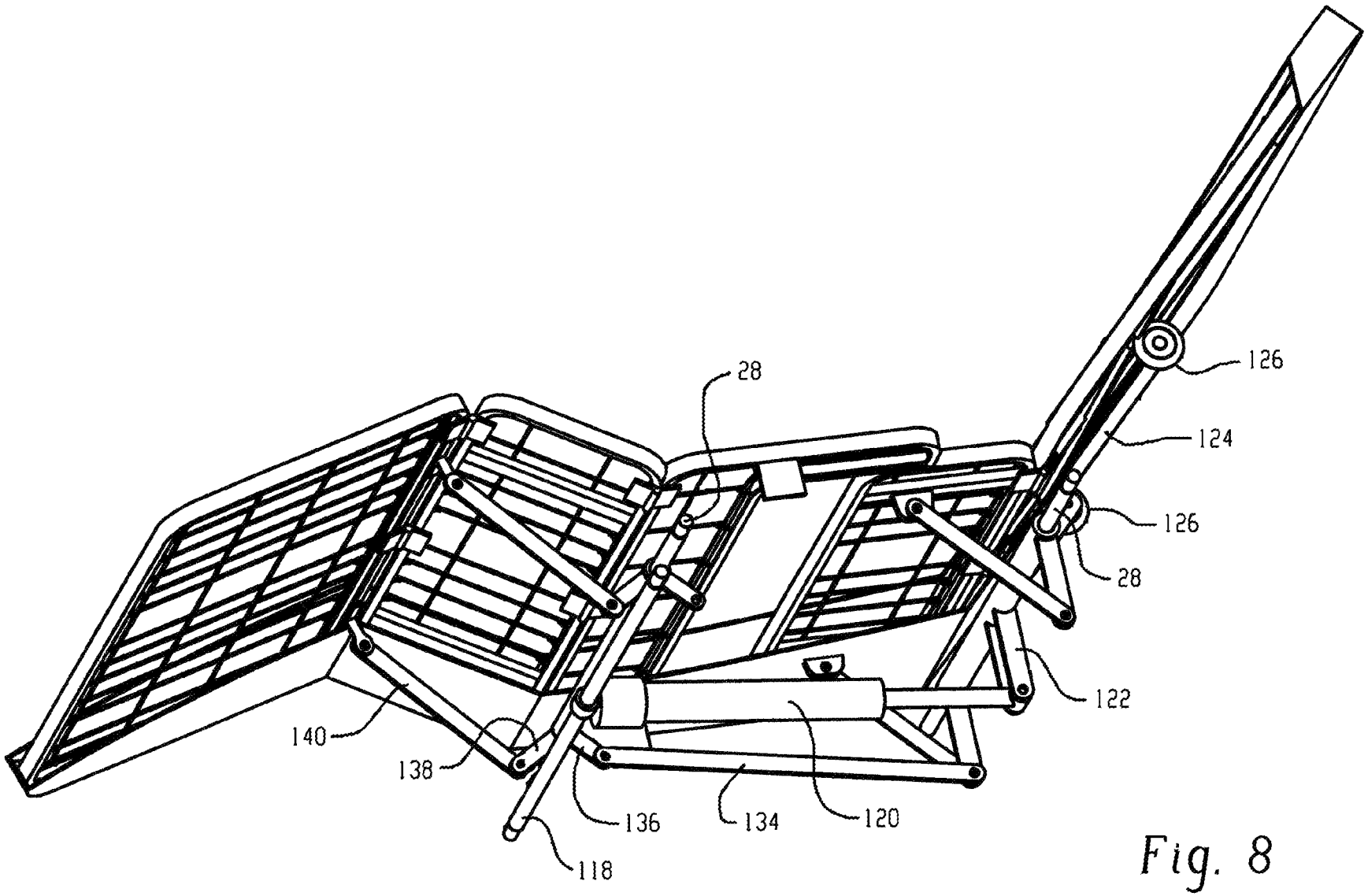
FIG. 8 is a bottom perspective view illustrating the mattress support surface and the linkage assembly frame in accordance with the present disclosure.
Figure 9:
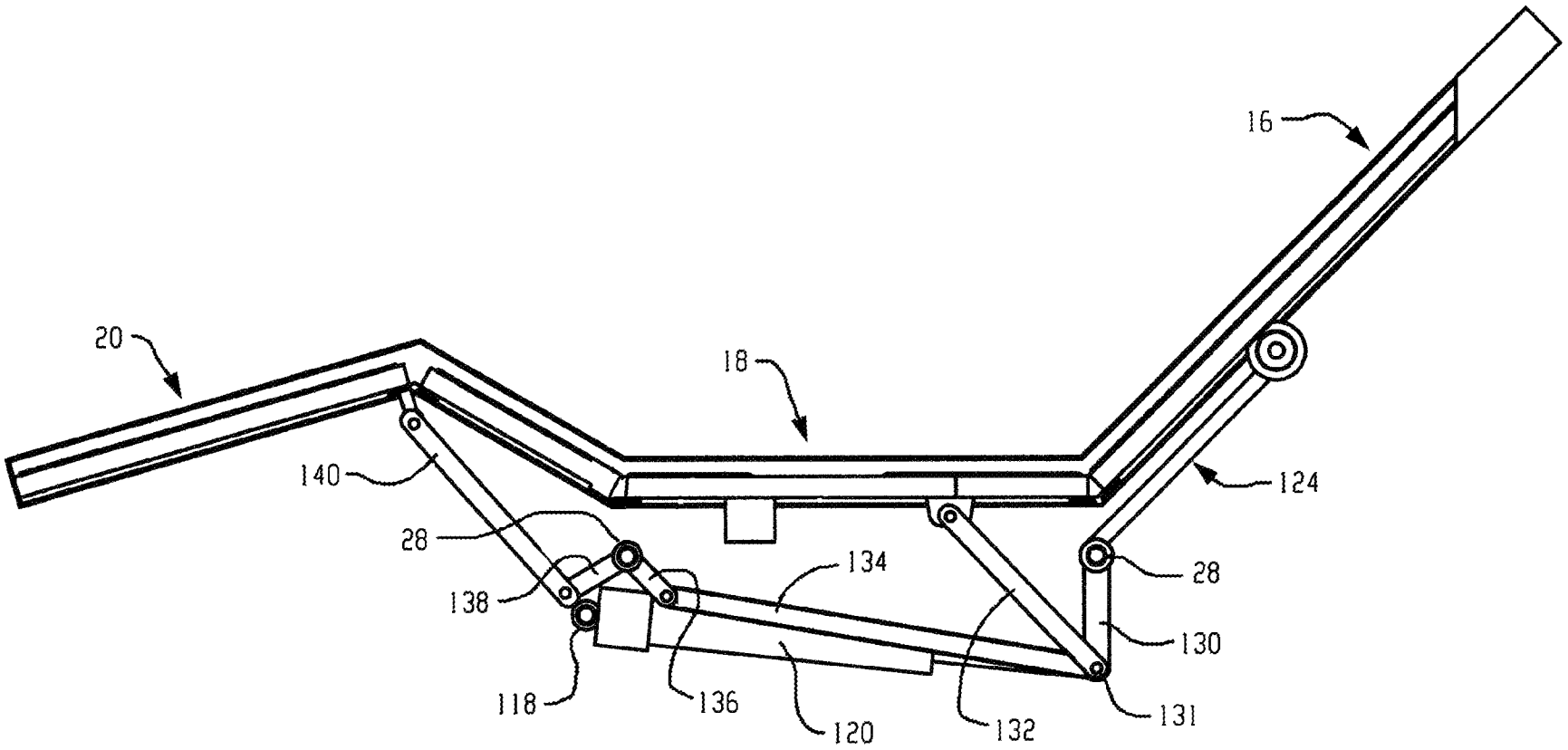
FIG. 9 is a side elevational view of illustrating the mattress support surface and the linkage assembly frame in accordance with the present disclosure.

Referring now to FIGS. 7-9, the linkage assembly 36 includes a linkage support frame 100 having a dimension configured to abut or be in close proximity to the interior perimeter of the foundation frame 32. The linkage support frame 100, which is seated on cross rails 48, includes side frame members 102, 104, and transverse frame members 106, 108 attached to respective ends of the side frame members to define a rectangular shape. The side frame members 102, 104 further include two pairs of pillars 110, 112, spaced apart from one another underlying the seat section. The pillars 110, 112, are configured to receive torsional members 28 extending between the side members 102, 104, which are operative with the linkage assembly 36 to articulate sections 16, 18, 20 of the adjustable foundation 10. Cross bar 118 is also attached to the side members 102, 104 as shown and is indirectly positioned underneath torsional member 28.

As shown more clearly in FIG. 7, a linear actuator 120 is attached at one end to the cross bar 118 and at the other end to crank arm 122. Crank arm 122 includes one end pivotally connected the end of the actuator 120 and the other end is fixedly attached to the torsional member 28. The linear actuator 122 in sub-foundation 12 includes a motor (not shown) effective to create actuator motion in a straight line so as to rotate the torsional member 28 upon extension and retraction of the linear actuator. The corresponding linear actuator 122 in sub-foundation 114 does not include a motor (not shown) coupled thereto. A pair of roller arms 124 is coupled at one end to torsional member 28 and includes a roller 126 at the other end. The roller arms 124 are spaced apart from one another and aligned with the longitudinal cross members 54 of the head and back section 16. In this manner, upon actuation of the linear actuator 120 to effect rotational movement of the torsional member 28, the rollers 126 contact the longitudinal cross members 54 upon inclination and declination of the head and back section 16.

Referring now to FIG. 9, a pair of crank arms 130 is attached at about respective ends to the torsional member 28. Link arms 132 are attached to the other end of the crank arms 130 to define pivot point 131 and to the rigid frame 74 of the first portion 66 of the intermediate or seat portion 18. Upon inclination/declination of the head and back portion 16, which is hingedly connected to the first portion 66, the torsional member 28 will rotate as a consequence of the extension/retraction of the linear actuator 120, which will move the first portion 66 relative to the second portion 68, thereby increasing or decreasing the length of the intermediate or seat section 20.

Link arms 134 include an end pivotally connected to the other end of the crank arms 130 and pivotally connected at the other end to crank arm 136. The other end of crank arm 136 is coupled to torsional member 28. As a result, upon extension/retraction of the linear actuator 120, torsional member 28 will rotate in addition to the other torsional member 28. Crank arms 138 are coupled to the torsional member 28 and is pivotally connected at the other end to link arm 140, wherein the other end of the link arm 140 is hingedly coupled to either the first portion 86 or the second portion 88 of the leg and foot section 22 at about the hinged connection such that rotation of the other torsional member 28 indirectly via linear actuator 120 will move the selected portion 86 or 88 of the leg and foot section 20 upwards or downwards depending on whether the leg and foot section is being raised or lowered. In the above described embodiment, the single actuator will provide simultaneous tilting (inclination/declination) of the head and back section 16 and tilting of the foot and leg section 20, wherein the intermediate or seat section 18 is lengthened relative to the flat position upon moving to a tilt position or shortened upon declination. Moreover, the above mechanism and configuration permits "wall hugging" placement of the mattress since the head and back section 16 pivots about a fixed axis defined by torsional member 28 and the motion and extension of the first portion 66 of the intermediate seat section 18 causes the head and back section 16 to slide towards the wall, i.e., towards a head end of the adjustable foundation assembly. By doing so, the adjustable mattress assembly, if having the head end abutting a wall, will cause the head and back section 16 to "wall hug", i.e., stay in close proximity to the wall regardless of inclination angle. Advantageously, this permits constant and easy access to a night table that may be disposed adjacent to the head and back section.

Figure 10:
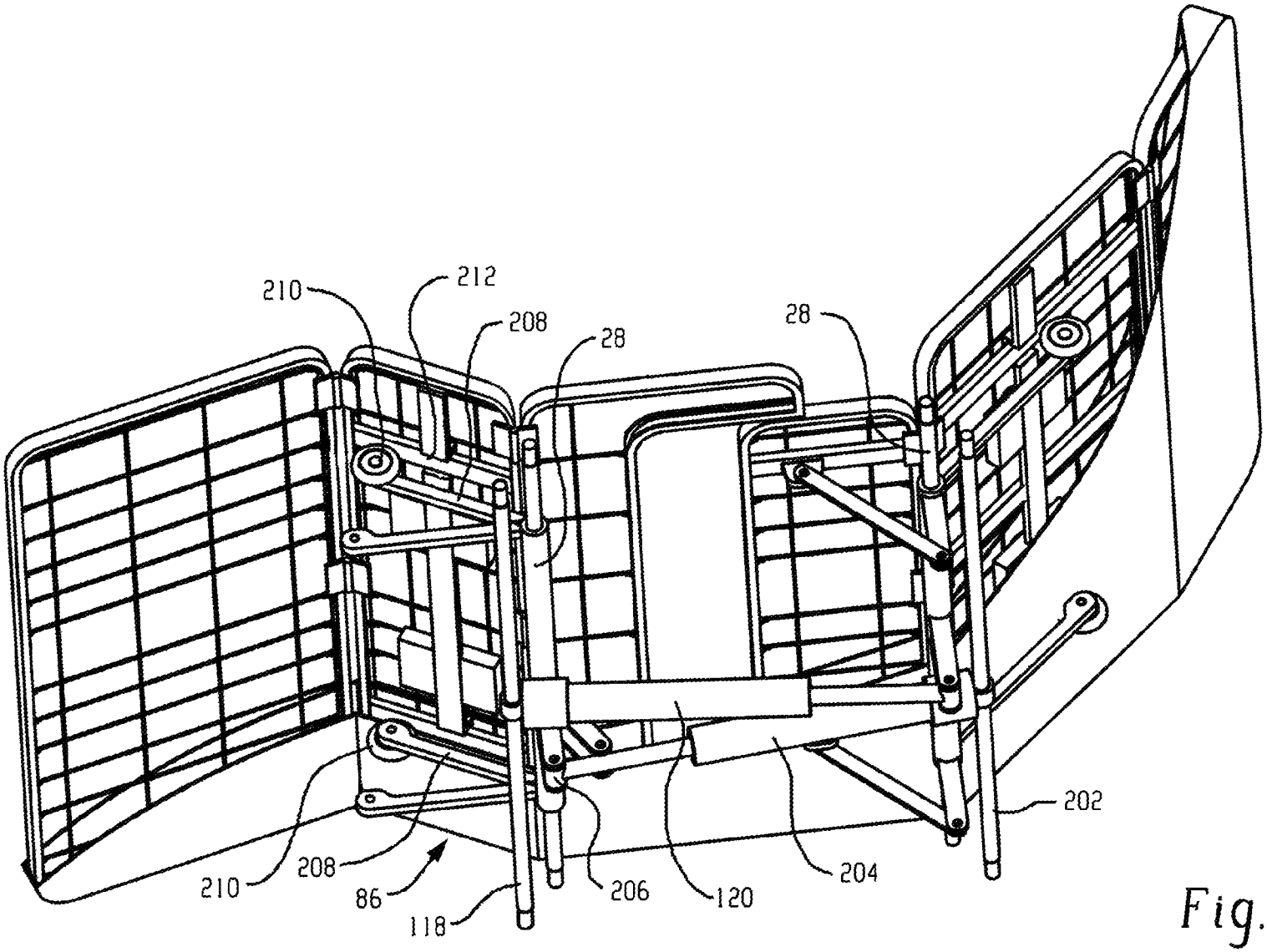
FIG. 10 is a bottom side perspective view of the mattress support surface and the linkage assembly in accordance with another embodiment.
Figure 11:
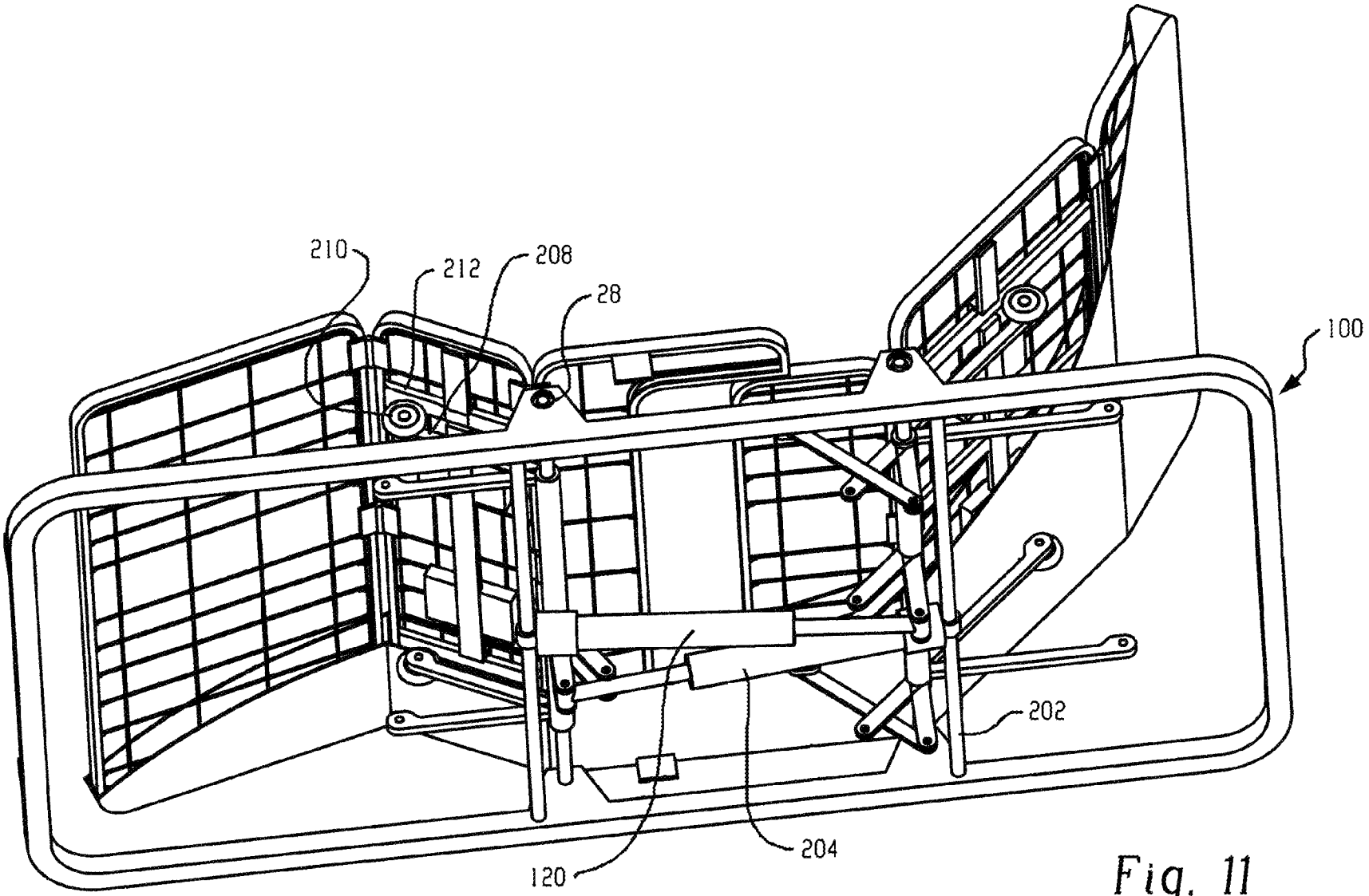
FIG. 11 is a perspective view illustrating the bottom of the mattress support surface, the linkage assembly, and linkage support frame in accordance with the embodiment of FIG. 10.

In another embodiment shown in FIGS. 10-11, the sub-foundation 12 includes a second actuator such that independent movement of the head and back section 16 and the leg and foot section 20 can be effected. In this embodiment, the mattress support frame 100 includes an additional cross bar 202 extending between side members 102, 104 and generally positioned underlying torsional member 28. A second linear actuator 204 is attached at one end to the cross bar 202 and pivotally connected at the other end to crank arm 206. Crank arm 206 is coupled at the other end to the other torsional member 28. Similar to the first linear actuator 120, the second linear actuator 204 includes a motor (not shown) effective to create actuator motion in a straight line so as to rotate the other torsional member 28 upon extension and retraction of the linear actuator. A pair of roller arms 208 is coupled at one end to torsional member 116 and includes a roller 210 at the other end. The roller arms 208 are spaced apart from one another, wherein the roller arms 208 are aligned with the longitudinal cross members 210 in the first portion 86 of the leg and foot section 22. In this manner, upon selective actuation of the second linear actuator 204 to effect rotational movement of the other torsional member 28, the rollers 210 contact the longitudinal cross members 212 upon inclination and declination of the head and back section 16.

In this embodiment, the first linear actuator 120 is free of crank arms 136, 138 and link arms 134, which were operable to articulate the leg and foot section 20 in the embodiment described above. As a result, selective actuation of the first linear actuator 120 is operative to move the first portion 66 of the intermediate or seat section 18 and effect inclination or declination of the head and back section 16. The end user then has the choice of selective actuation of the first and/or second linear actuators 120 and/or 204, respectively, to provide the desired positioning of the mattress support surface 34.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An adjustable mattress assembly dimensioned to support a mattress configured to accommodate two supine users, comprising:

a foundation frame comprising a first sub-foundation and a second sub-foundation, wherein the first sub-foundation abuts and has similar dimensions as the second sub-foundation, wherein the first and second sub-foundations comprise side frame members and transverse frame members attached at respective ends of the side frame members to define a generally rectangular shape, and at least one cross rail extending between the side frame members, wherein each of the first and second sub-foundations includes a mattress support surface collectively configured to support a mattress dimensioned to accommodate the two supine users, the mattress support surface including a head and back section hingedly connected to an intermediate seat section at one end and a leg and foot section hingedly connected to the intermediate seat section at another end, wherein the intermediate seat section includes a first portion and a second portion, wherein the first portion is hingedly connected to the head and back section and the second portion is hingedly connected to the leg and foot section;

a linkage assembly in each of the first and second sub-foundations, wherein the linkage assembly comprises a linkage support frame configured to be seated on the respective sub-foundation frame, first and second spaced apart torsional members coupled to the linkage support frame underlying each end of the intermediate seat section, a cross bar coupled to the linkage support frame and underlying a selected one of the first and second torsional members, and link arms having an end pivotally connected to crank arms coupled to the first and/or second torsional members;

first and second shafts mechanically coupling the first and second torsional members in the first sub-foundation to the first and second torsional members in the second sub-foundation; and one or more motorized actuators in the first sub-foundation having one end coupled to the cross rail and another end coupled to one of the crank arms effective to selectively rotate the first and/or second torsional members in the first sub-foundation to effect inclination or declination of the head and back section and/or the leg and foot section, wherein rotation of the first and/or second torsional members in the first sub-foundation rotates the first and/or second torsional members in the second sub-foundation via rotation of the first and/or second shafts.

2. The adjustable mattress assembly of claim 1, wherein the first and second sub-foundations further comprise legs at each corner of the respective generally rectangular shape, wherein the legs elevate the first and second sub-foundations relative to ground.

3. The adjustable mattress assembly of claim 2, further comprising a leg connector mechanically coupling abutting legs of the first sub-foundation and the second sub-foundation.

4. The adjustable mattress assembly of claim 3, wherein the leg connector comprises a substantially rigid planar material including a first opening and a second opening configured abutting corner legs of the first sub-foundation and the second sub-foundation.

5. The adjustable mattress assembly of claim 1, wherein the first and second torsional members in the first sub-foundation to the first and second torsional members in the second sub-foundation including an opening at an end configured to receive a corresponding end of the first and second shafts.

6. The adjustable mattress assembly of claim 2, further comprising a leg cover coupled to abutting corner legs of the first and second sub-foundations.

7. The adjustable mattress assembly of claim 1, wherein the first portion of the intermediate seat section is rectangularly shaped and the second portion is generally u-shaped such that upon extension and retraction of the first actuator, the first portion of the intermediate seat section moves towards or away from an opening defined by the u-shaped second portion, thereby lengthening or shortening the intermediate seat section.

* * * * *